US010890354B1

(12) United States Patent
Kane et al.

(10) Patent No.: US 10,890,354 B1
(45) Date of Patent: Jan. 12, 2021

(54) SYSTEM FOR FACILITATING THE CLEANING OF A MINI-SPLIT AIR HANDLING UNIT

(71) Applicants: Timothy Kane, Stamford, CT (US); Michael Hardy, Stamford, CT (US); Victor A. Ceci, Stamford, CT (US); Keith Froehlich, Stamford, CT (US)

(72) Inventors: Timothy Kane, Stamford, CT (US); Michael Hardy, Stamford, CT (US); Victor A. Ceci, Stamford, CT (US); Keith Froehlich, Stamford, CT (US)

(73) Assignee: CROSSFORD International, LLC, Stamford, CT (US)

( * ) Notice: Subject to any disclaimer, the term of this patent is extended or adjusted under 35 U.S.C. 154(b) by 0 days.

(21) Appl. No.: 17/066,739

(22) Filed: Oct. 9, 2020

(51) Int. Cl.

| | |
|---|---|
| ***F24F 1/00*** | (2019.01) |
| ***F24F 13/32*** | (2006.01) |
| ***F24F 1/0003*** | (2019.01) |
| ***F24F 13/20*** | (2006.01) |
| ***B65D 33/14*** | (2006.01) |
| ***B65D 33/00*** | (2006.01) |
| ***B67C 11/02*** | (2006.01) |
| ***F28G 9/00*** | (2006.01) |
| *F28G 13/00* | (2006.01) |

(52) U.S. Cl.
CPC ..... *F24F 13/32* (2013.01); *B65D 33/00* (2013.01); *B65D 33/14* (2013.01); *B67C 11/02* (2013.01); *F24F 1/00* (2013.01); *F24F 1/0003* (2013.01); *F24F 13/20* (2013.01); *F28G 9/00* (2013.01); *F24F 2221/17* (2013.01); *F24F 2221/22* (2013.01); *F28G 13/00* (2013.01)

(58) Field of Classification Search
CPC ..... B67C 11/02; B65D 33/00; B65D 33/14; F28G 9/00; F28G 13/00; F28G 15/00; F24F 1/00
See application file for complete search history.

(56) References Cited

U.S. PATENT DOCUMENTS

| | | | |
|---|---|---|---|
| 9,259,769 B1 | 2/2016 | Kane | |
| 10,144,628 B1 | 12/2018 | Hardy | |

FOREIGN PATENT DOCUMENTS

| | | | | |
|---|---|---|---|---|
| CN | 201277684 Y | * | 7/2009 | |
| JP | 2000179888 A | * | 6/2000 | |
| WO | WO-2012100282 A1 | * | 8/2012 | ..... B08B 3/04 |

* cited by examiner

*Primary Examiner* — Shay Karls
(74) *Attorney, Agent, or Firm* — Todd S. Sharinn; Gilbridge, Tusa, Last and Spellane, LLC

(57) ABSTRACT

A system for collecting waste fluid and debris from cleaning of an air handler mounted in a wall, comprising a one-piece shroud disposable on the air handler assembly, the shroud including a hood portion and a funnel portion connected by left and right sides, the shroud having a front opening and a rear opening between the hood and the funnel; a left bracket and a right bracket having respective left and right flanges disposable between left and right sides of the air handler assembly and the wall; a cinchable drawstring; an upper rib disposed in the hood portion and having hooked ends for engaging slots in the left bracket and the right bracket; and a lower rib disposed in the funnel portion and having hooked ends for engaging slots in the left bracket and the right bracket.

8 Claims, 10 Drawing Sheets

SYSTEM FOR FACILITATING THE CLEANING OF A MINI-SPLIT AIR HANDLING UNIT

RELATIONSHIP TO OTHER APPLICATIONS AND PATENTS

Incorporated by reference herein in their entirety are U.S. Pat. No. 9,259,769, which issued on Feb. 16, 2016, and U.S. Pat. No. 10,144,628, which issued on Dec. 4, 2018.

TECHNICAL FIELD

The present invention relates to systems and methods for cleaning and maintaining mini-split air conditioning systems, and particularly to a system for collecting waste fluid and debris resulting from cleaning of an air conditioning air handler assembly mounted in a supporting wall.

BACKGROUND OF THE INVENTION

The present invention is directed to the art of cleaning the fins of air conditioning units, and in particular to disposal of water and cleaner fluids used in the course of cleaning the units. The air conditioning units with which the invention is used provide heated or cooled air for an interior living space according to season of the year, and are known in the art colloquially as "mini-split" heat exchangers. The invention may also be applied in the collection and disposal of liquids and fluids from similar cleaning operations of similar air handling units.

In order to maintain thermodynamic efficiency of air conditioning units, it is necessary periodically to clean the condenser tube surfaces and fins. Room air conditioning units of concern here are situated in residences and offices in close proximity to furniture, residents, and office workers, so care and finesse are needed to avoid fluid drips and splatters when cleaning air conditioning coils in these settings.

The present invention is directed to an apparatus and method for collecting fluids from cleaned A/C units and for directing such fluids to a floor drain or sewer, or to a collection container for later disposal. In other applications, the invention may be used for collection and disposal of fluid and related debris when leaks occur, or equipment fails, and so forth.

SUMMARY OF THE INVENTION

The present invention is directed to an improved system and method for cleaning a mini-split air conditioning apparatus.

The system comprises a one-piece flexible plastic shroud having a hood portion and a funnel portion. The hood portion has a front opening for operator access to the front of a mini-split air conditioner to be cleaned and a rear opening disposable around the air conditioning unit and secured by one or more cinchable drawstrings fitted through loops around the rear opening. The funnel portion is connected to and deployed below the hood portion and is tapered to a bottom outlet. Left and right rigid plastic brackets each have flanges insertable between the surrounding wall and the left and right sides of the air conditioning unit. The drawstring passes through the brackets to help to hold them in place. The hood portion and the funnel portion are supported respectively by first and second curved ribs that pass through hems formed in the outer edges of the respective portions and have hooks on their ends for engaging with mating slots in the left and right brackets to hold the hood and funnel portions unfurled in operating position. In operation, the ribs may be pivoted upward or downward in the brackets to facilitate operator access to the air handling unit.

The system may be fully assembled by the manufacturer and shipped to a customer ready for installation wherein the rear opening of the shroud is positioned over the air conditioning unit, the left and right brackets are inserted as described above, the drawstring is cinched tight around the air conditioning unit, and the ends of the first and second ribs and inserted into their respective bracket slots to hold the hood and funnel portions in operating position.

Preferably, the ribs are sufficiently flexible in the longitudinal direction that the entire assembly may be rolled together as a unit and fitted into a convenient container such as a five-gallon pail for delivery or storage.

BRIEF DESCRIPTION OF THE DRAWINGS

The present invention will now be described, by way of example, with reference to the accompanying drawings, in which.

DETAILED DESCRIPTION OF THE INVENTION

Figure 1:
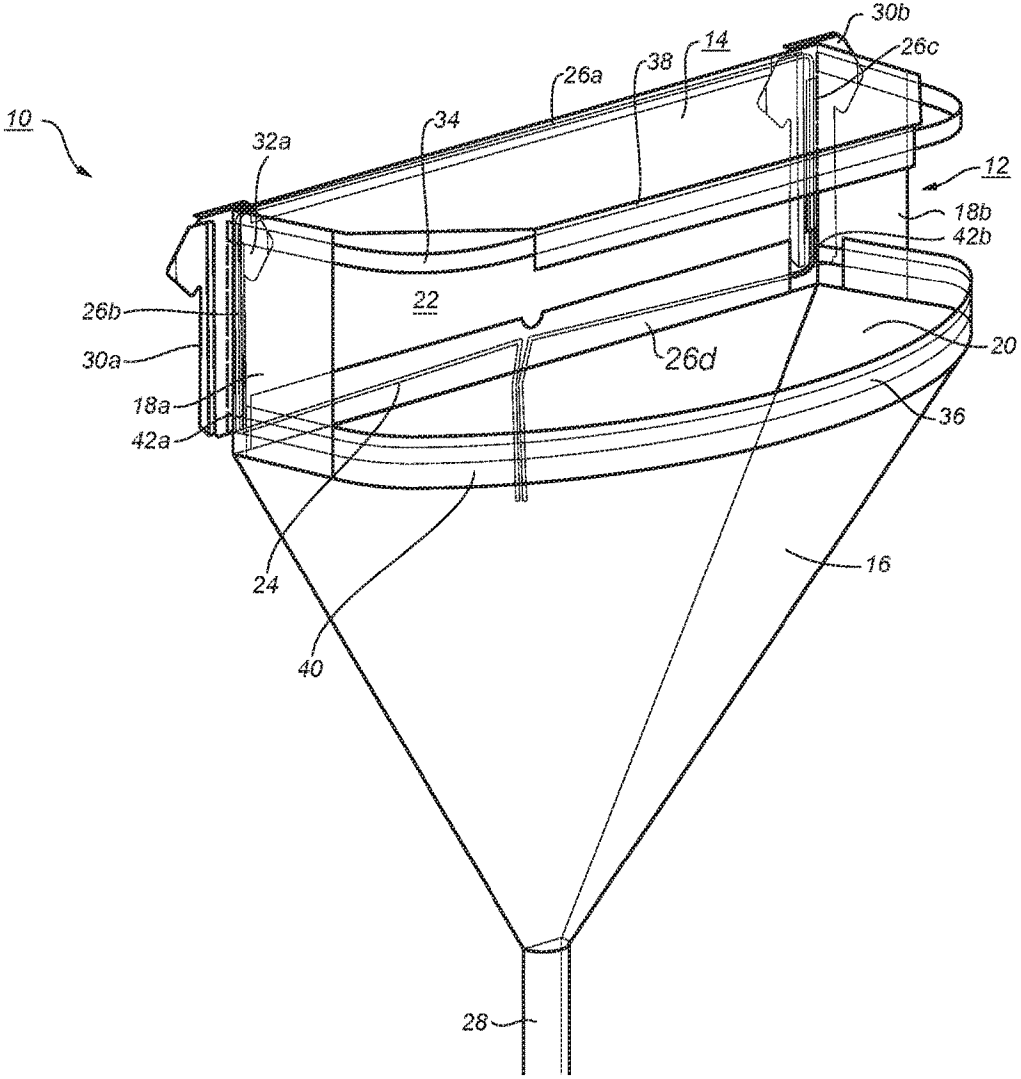
FIG. 1 is a perspective view of a complete assembly in accordance with the present invention.
Figure 2:
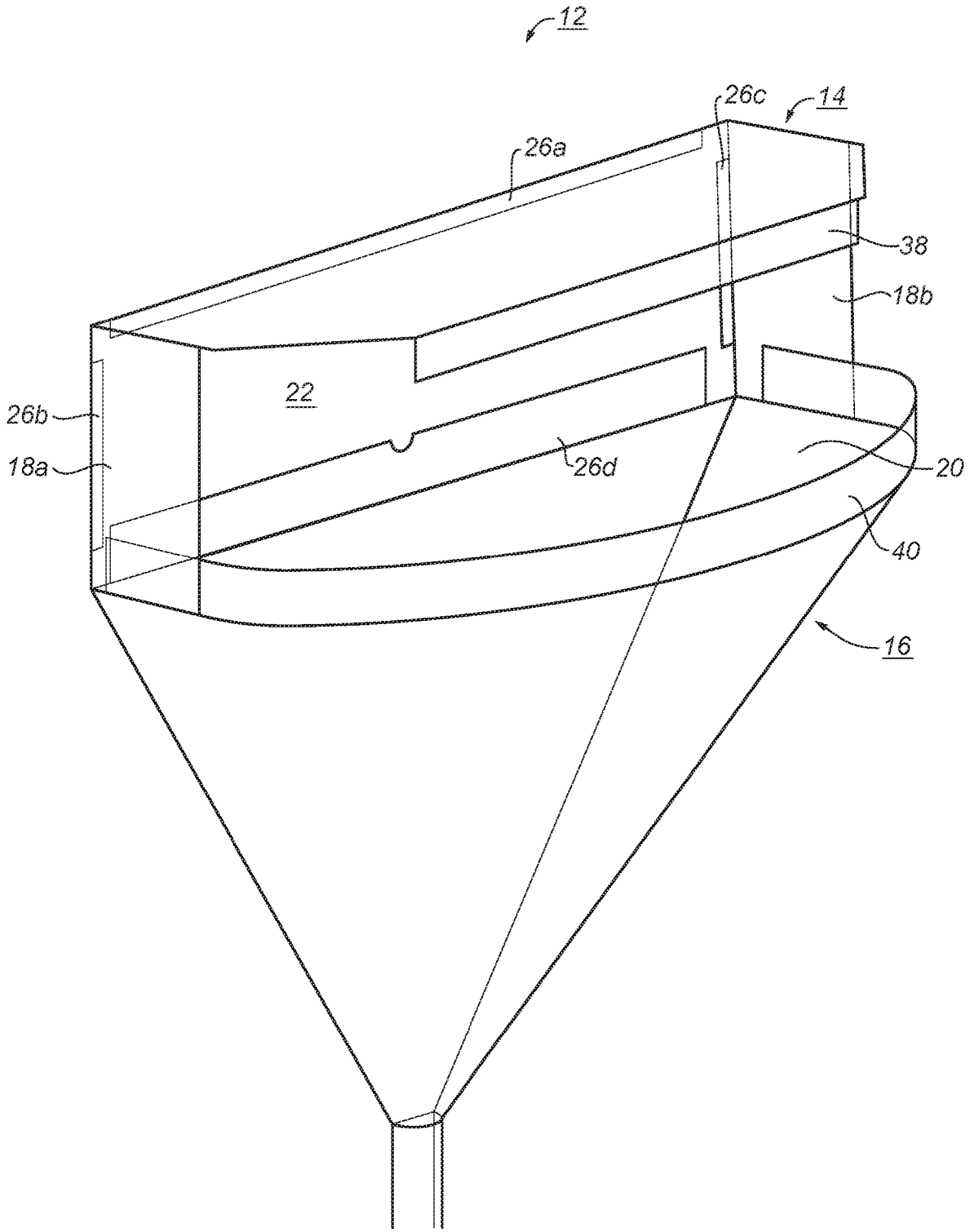
FIG. 2 is a perspective view of the cleaning shroud shown in FIG. 1.

Throughout the following description, specific elements are set forth in order to provide a more thorough understanding of the invention. However, in some embodiments the invention may be practiced without some of these elements. In other instances, well known elements have not been shown or described in detail to avoid unnecessarily obscuring the disclosure. Accordingly, the specification and drawings are to be regarded as illustrative rather than restrictive. It is to be further noted that the drawings may not be to scale.

Referring now to FIGS. 1 through 10, an improved system 10 for cleaning a mini-split air conditioning unit (not shown) in accordance with the present invention is shown. System 10 comprises a one-piece plastic shroud 12, preferably flexible and formed of a thin plastic sheeting such as polyethylene, although rigid plastic embodiments are also contemplated by the present invention. Shroud 12 includes an upper hood portion 14, a lower funnel portion 16, and left and right side shields 18*a*,18*b* connecting the hood and funnel portions into a single entity.

One-piece shroud 12 has a front opening 20 between the hood and funnel portions for operator access to the front of a mini-split air conditioner to be cleaned and a rear opening 22 disposable around an air conditioning unit (not shown) protruding from a wall. Shroud 12 is secured to the air conditioning unit by a cinchable drawstring 24 fitted through open hems 26*a*,26*b*,26*c*,26*d* in the hood portion, funnel portion, and side shields around the rear opening. The funnel portion is deployed below the hood portion and is tapered to a bottom outlet 28. Left and right rigid plastic brackets 30*a*,30*b* each have flanges 32*a*,32*b* insertable between the surrounding wall (not shown) and the left and right sides of the air conditioning unit. Drawstring 24 passes through brackets 30*a*,30*b* to help to hold them in place. Hood portion 14 and funnel portion 16 are supported in operating position respectively by upper and lower curved supportive ribs 34,36 that are installed in hems 38,40 formed in the outer edges of the respective hood and funnel portions and have hooks 44*a*,44*b* on their ends (FIGS. 5,6,7,8; not visible in FIG. 1) for engaging with mating slots 42*a*,42*b* in left and right brackets 30*a*,30*b* to hold the hood and funnel portions unfurled in operating position.

Figure 3A:
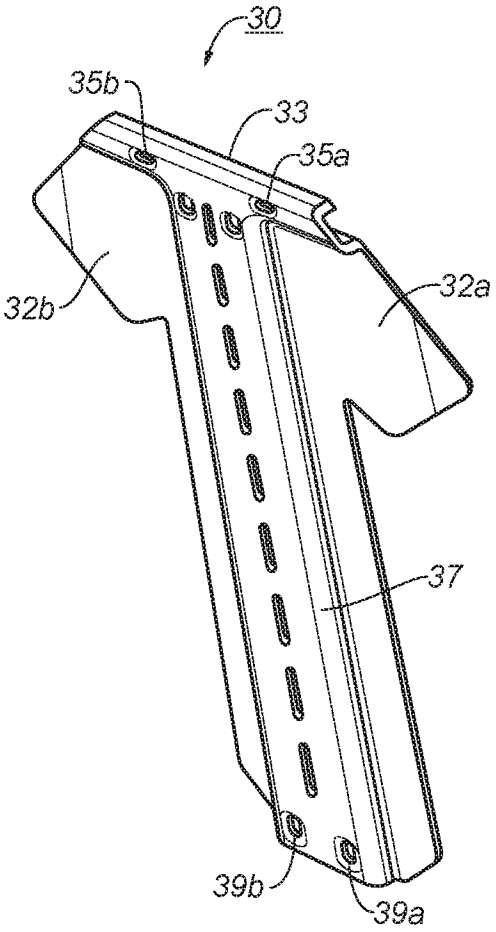
FIG. 3*a* shows an elevational view and a perspective view of a first embodiment of a wall bracket as shown in FIG. 1.
Figure 3A:
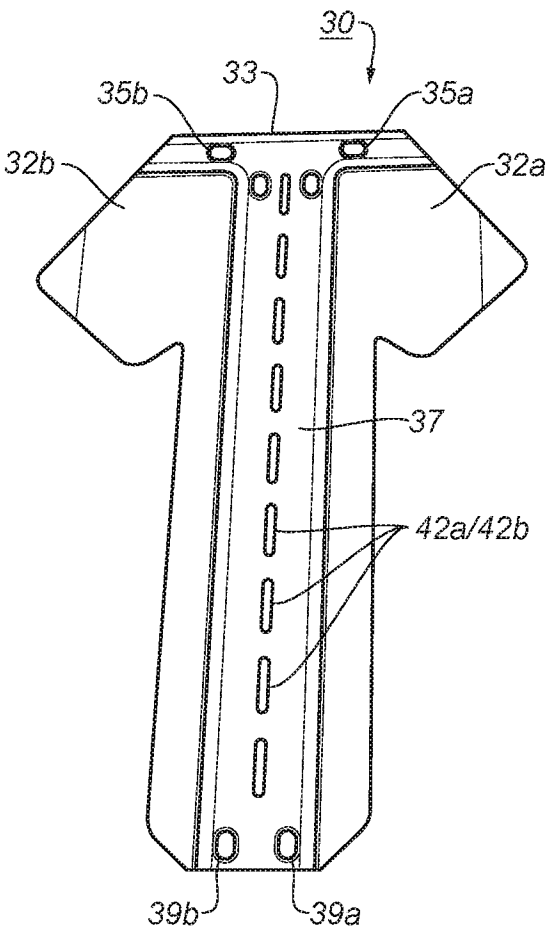

As shown in FIG. 3*a*, brackets 30*a*,30*b* are preferably identical such that a single bracket design 30 is suitable for either left or right side installation, having both flanges 32*a* and 32*b*. A top element 33 is provided with first and second holes 35*a*,35*b* for receiving drawstring 24 to hold the left and right brackets in place during installation of system 12. A central portion 37 is raised, hollow, and slotted 42*a*,42*b* to receive hooks 44*a*,44*b* (FIG. 8) in the manner of a shelf bracket and cooperating slotted shelf riser. Brackets 30*a*,30*b* are further provided with third and fourth holes 39*a*,39*b* for engaging drawstring 24 as shown in FIG. 1. Bracket 30 preferably is formed of a rigid plastic as by stamping or injection molding.

Figure 3B:
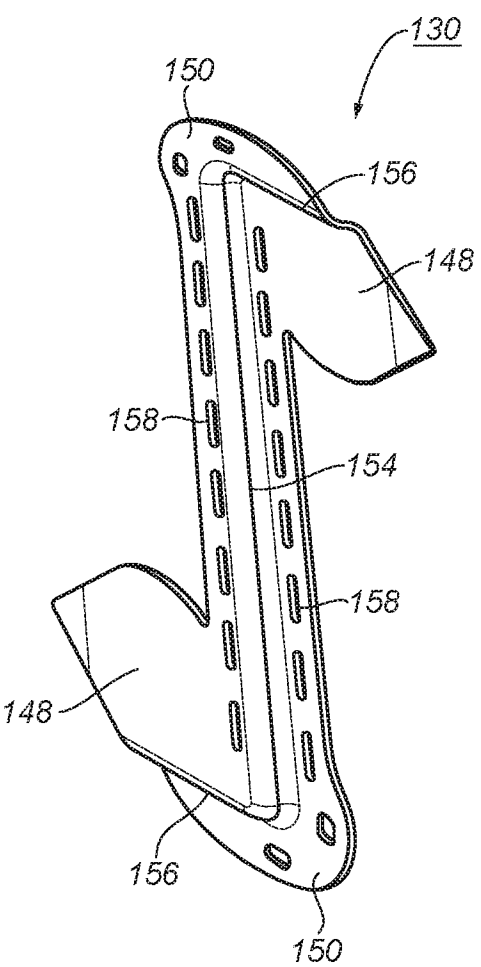
FIG. 3*b* shows an elevational view and a perspective view of a second embodiment of a wall bracket suitable for alternative use in the present invention.
Figure 3B:
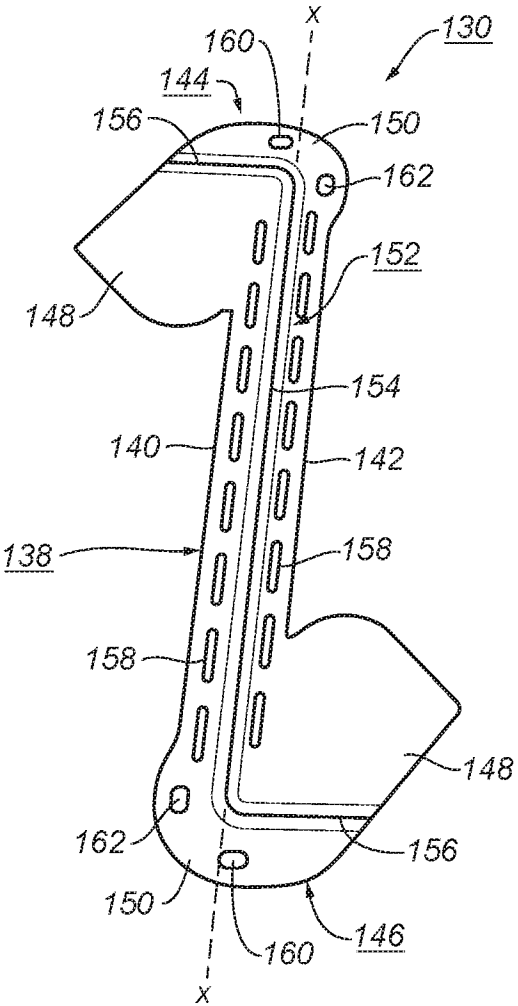
Figure 8:
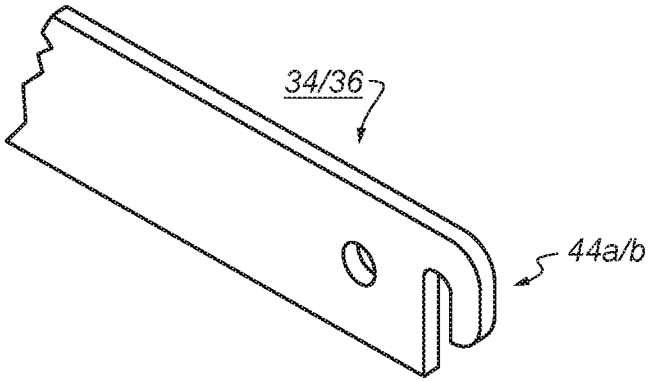
FIG. 8 is a perspective view showing detail of the end of a supportive rib in accordance with the present invention.

Referring now to FIG. 3*b*, an alternative bracket configuration 130, substantially as shown in FIG. 8 in incorporated U.S. Pat. No. 9,259,769, comprises an elongate plate 138 having side edges 140,142, a longitudinal axis x-x, first and second ends 144,146 spaced from each other along axis x-x, an integral flange 148 and crown 150 at both ends extending in opposed directions from the axis, and a Z-shaped ridge 152 including central ridge 154 along the axis and right angle ridges 156 at both ends separating flange and crown. Two rows of slots 158 extend axially of the plate on either side of the central ridge, and apertures 160,162. The preferred embodiment of FIG. 3*b* comprises a single side bracket configuration that can be used on both the left and right sides of an air handler assembly. The Z-shape ridge serves as a stop for limiting movement of the bracket into the space between the air handler assembly and a supporting wall so that the bracket exposes slits and openings and provides a necessary base for securing drawstring 24.

In addition to providing anchorage for drawstring 24, in one embodiment bracket 130 also may extend laterally along the wall (not shown) in any desired shape or size to provide additional protection for the supporting wall against deflection, splashing, and damage by fluids and debris.

Figure 4:
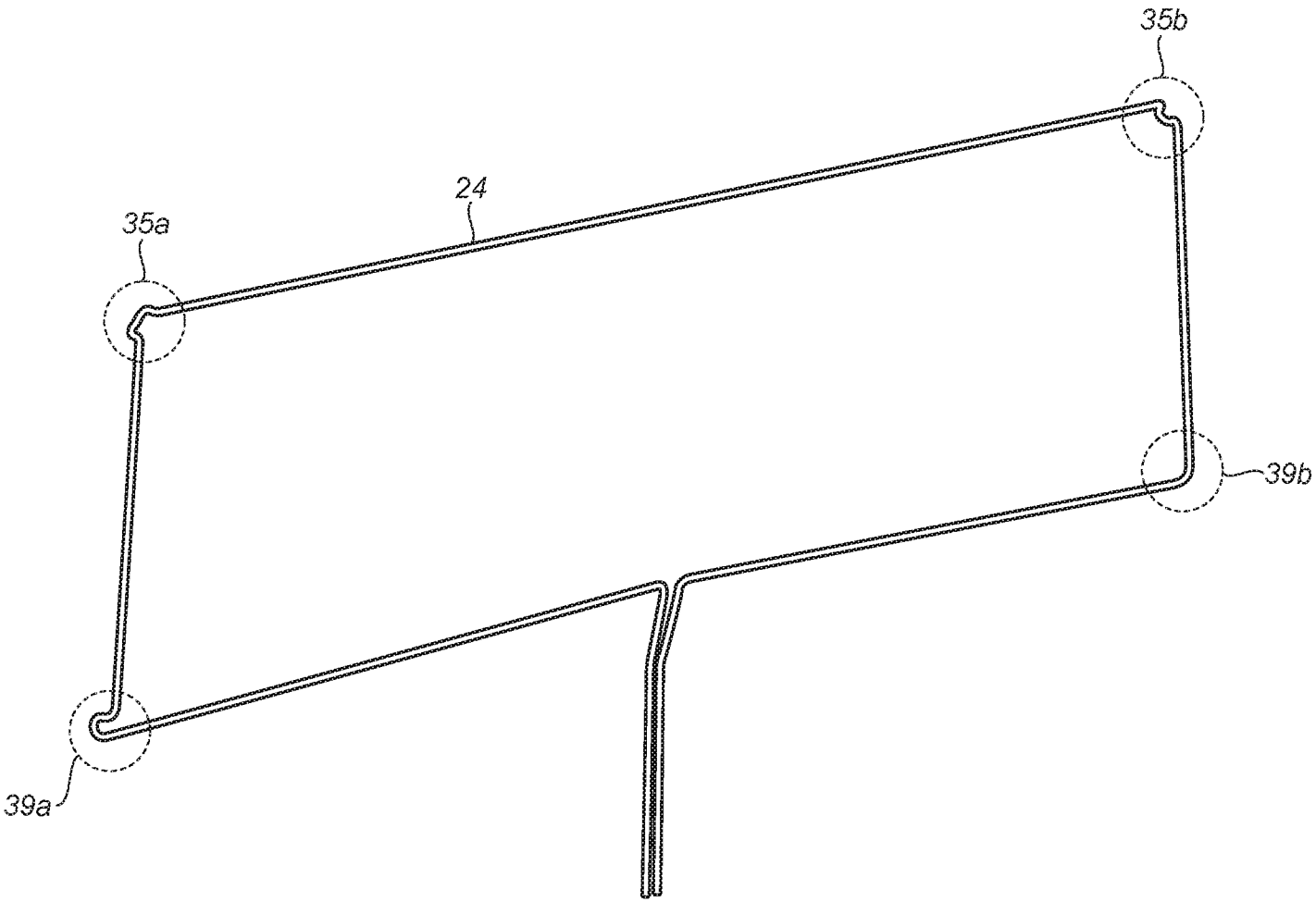
FIG. 4 is a perspective view of the drawstring shown in FIG. 1.
Figure 5:
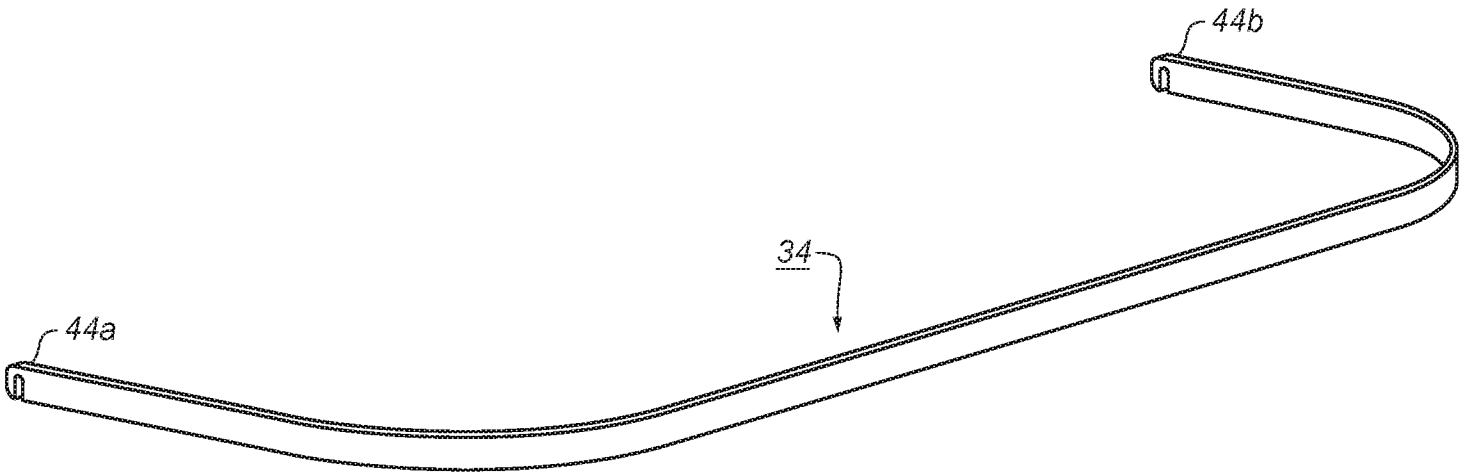
FIG. 5 is a perspective view of the upper supportive rib shown in FIG. 1.
Figure 6:
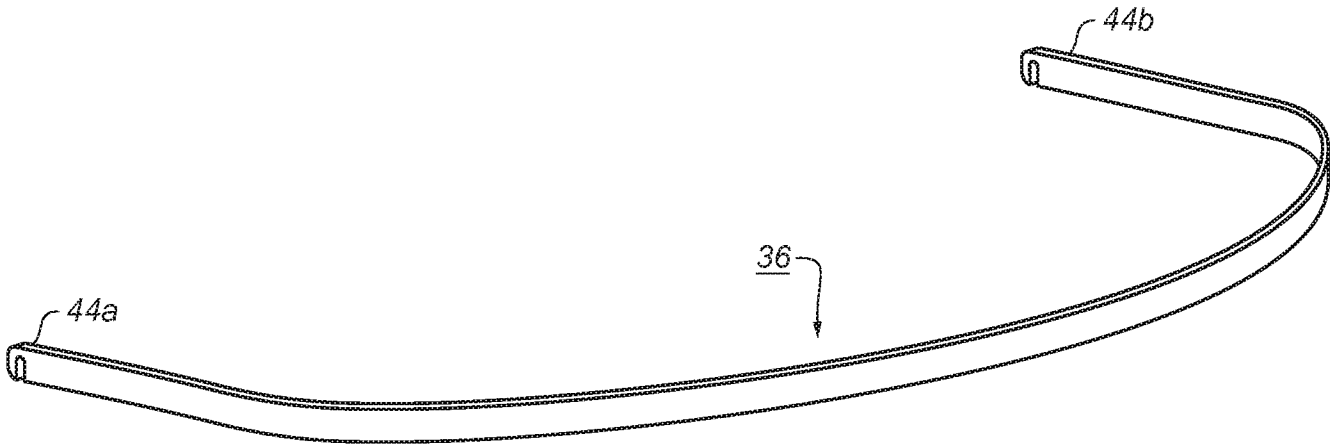
FIG. 6 is a perspective view of the lower supportive rib shown in FIG. 1.
Figure 7:
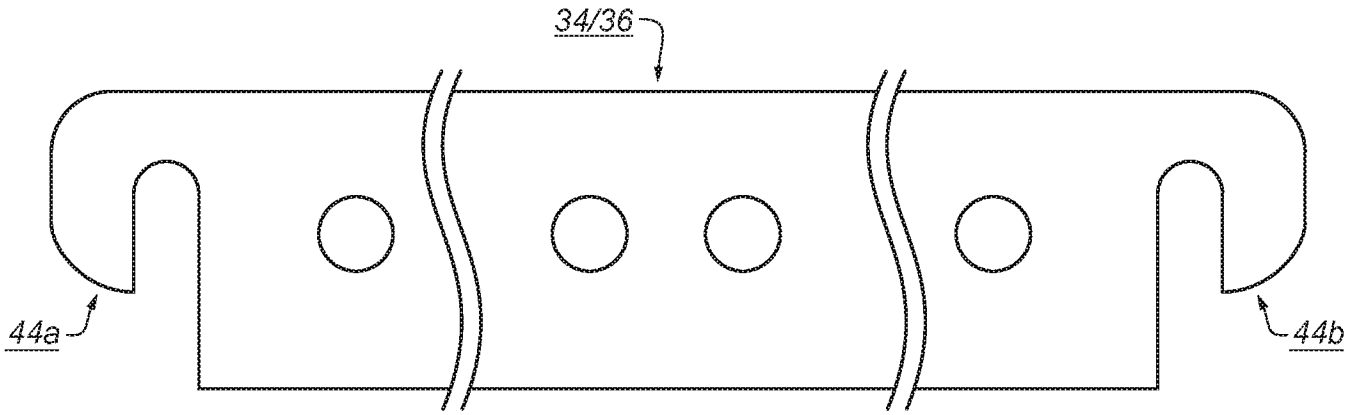
FIG. 7 is an elevational view of either the upper or lower supportive ribs shown in FIGS. 1, 5, and 6.
Figure 9:
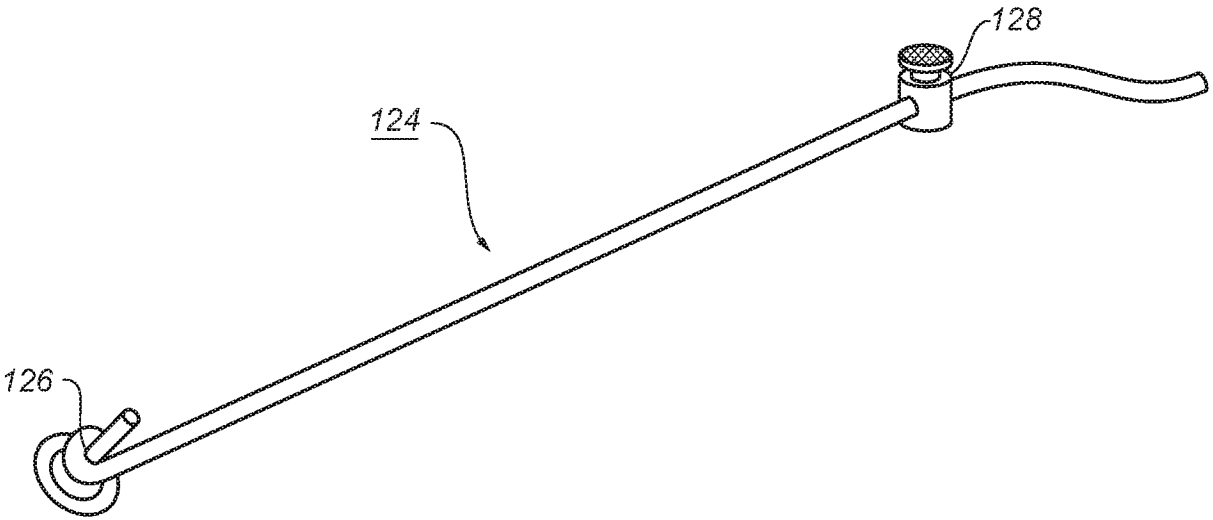
FIG. 9 is a perspective view showing detail of an alternative drawstring embodiment in accordance with the present invention.

Referring now to FIGS. 4 and 9, drawstrings 24 or 124 are shown disposed in respective operating configurations. The dotted circles in FIG. 4 indicate where drawstring 24 is passed through holes 35*a*,35*b*,39*a*,39*b*, respectively, in brackets 30.

In an alternative embodiment, two drawstrings 124 (upper and lower) are required. As shown in FIG. 9, each drawstring is knotted 126 at one end and provided with a slidable spring clamp 128. In installation, upper drawstring 124 is passed through upper hood hem 26*a* and left bracket hole 35*a* and is knotted, securing a left upper drawstring end to left bracket 30. The right end of upper drawstring 124 is then passed through hole 35*b* in right bracket 30, and spring clamp 128 is disposed on the running end of upper drawstring 124. An identical lower drawstring 124 is similarly disposed in left bracket hole 39*a*, lower funnel hem 26*d*, and right bracket hole 39*b*. The arrangement permits system 10 to be used on air conditioner units of varying widths by varying the position of clamp 128 on its own drawstring 124.

Referring now to FIGS. 5 through 8, upper and lower supportive ribs 34,36 are shown. Ribs 34,36 are formed of a flexible plastic strap material, e.g., polypropylene, polyethylene terephthallate, etc. that is horizontally relatively thin and vertically relatively thick, as shown in FIG. 8. Each rib is provided with hooked ends 44*a*,44*b* for insertion into the respective appropriate or desired slots 42*a*,42*b* in brackets 30*a*,30*b* such that hood portion 14 and funnel portion 16 are outwardly deployed.

Figure 10:
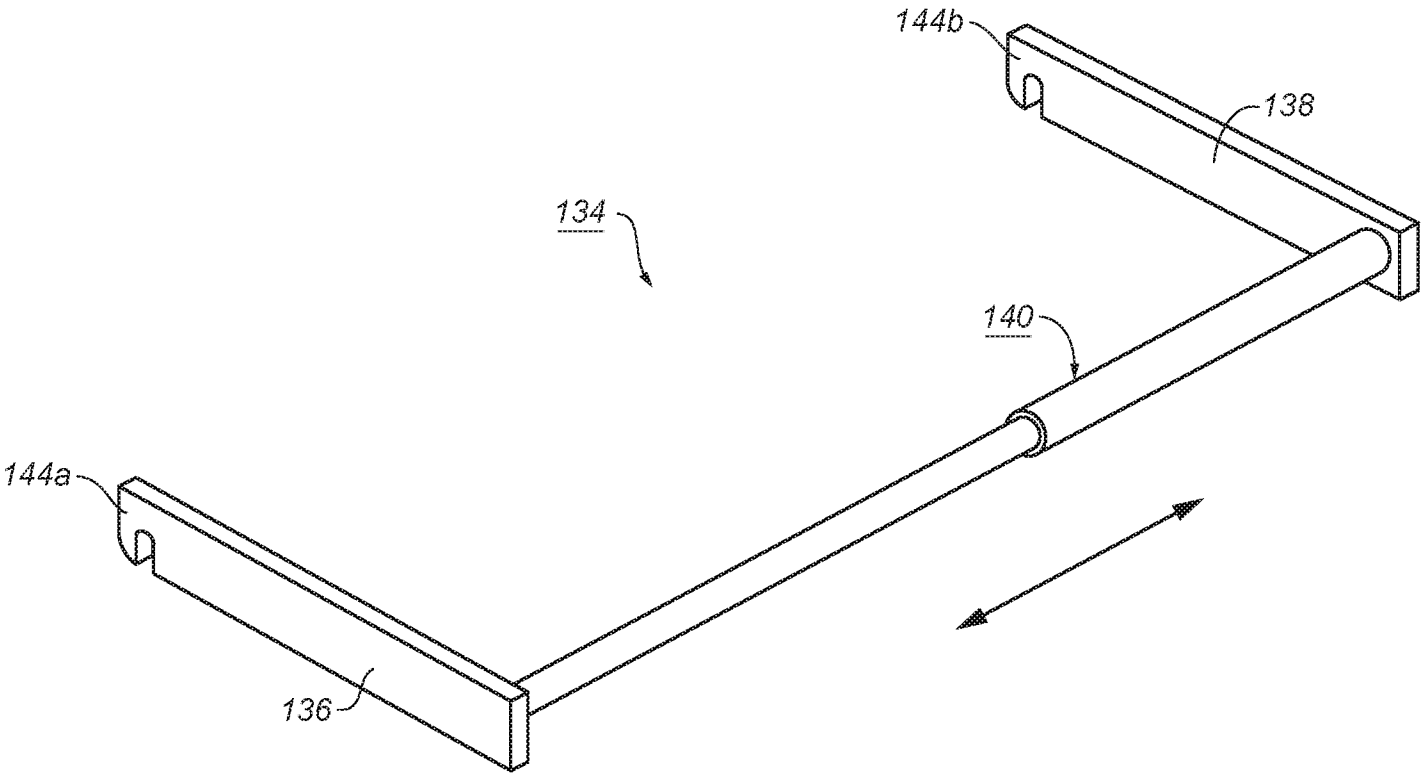
FIG. 10 is a perspective view showing detail of an alternative supportive rib in accordance with the present invention.

Referring now to FIG. 10, an alternative supportive rib 134 may be substituted for either of ribs 34,36 as may be desired. Rib 134 comprises respective left and right arms 136,138, each having hooked ends 144*a*,144*b* like ends 44*a*,44*b* described hereinabove. A telescoping transverse rod 140 is disposed between arms 136,138 such that the distance between arms 136,138 may be adjusted to fit air conditioner units of varying widths, in cooperation with upper and lower drawstrings 124 as described hereinabove, and left and right brackets 30*a*,30*b*.

System 10 may be fully assembled for storage and shipment except for having the rib hooks inserted into the brackets, i.e., the drawstring is installed in the appropriate hems and through the appropriate holes in the side brackets, and the upper and lower ribs are installed in the hems in the hood and funnel portions. Because ribs 34,36 are flexible, they can accommodate some differences in air handler widths. The assembly may be rolled up as a unit ready for service. A conventional 5-gallon pail (not shown) is a convenient container for storage and shipping, as it is also useful for catching liquid passing through the funnel drain during cleaning use of the system.

In operation, a rolled up system 10 is first removed from the storage container. System 10 is unrolled, and the rear opening 22 and drawstring 24 are positioned surrounding the air conditioning unit to be cleaned. Left and right brackets 30*a*,30*b* are positioned beside the AC unit with respective flanges 32*a*,32*b* inserted between the AC unit and the wall. Drawstring 24 or 124 is cinched to secure system 10 to the AC unit. The hooked ends 44*a*,44*b* of the upper and lower ribs 34,36 are inserted into the appropriate slots 42*a*,42*b* of brackets 30*a*,30*b* to complete the unfurling of system 10. Preferably, the 5-gallon storage container is placed under funnel end 28 to catch liquid waste from the cleaning process. The system is now ready for operation.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A system for collecting waste fluid and debris resulting from cleaning of an air conditioning air handler assembly mounted in a supporting wall, comprising:

a) a one-piece shroud disposable on said air conditioning air handler assembly, said shroud including a hood portion and a funnel portion connected by left and right side portions, said shroud having a front opening and a rear opening between said hood portion and said funnel portion;

b) a left side bracket and a right side bracket having respective left and right flanges disposable between respective left and right sides of said air conditioning air handler assembly and said wall;

c) at least one cinchable drawstring disposed in at least one of said hood portion, said left side bracket, said right side bracket, and said funnel portion to secure said system to said air conditioning air handler assembly;

d) an upper supportive rib disposed in a front hem in said hood portion and having left and right hooked ends for engaging slots in said left side bracket and said right side bracket, respectively; and e) a lower supportive rib disposed in a front hem in said funnel portion and having left and right hooked ends for engaging said left side bracket and said right side bracket, respectively.

2. A system in accordance with claim 1 wherein said funnel portion includes a bottom drain opening.

3. A system in accordance with claim 1 wherein a single bracket design, having both of said left and right flanges, serves for both said left side bracket and said right side bracket.

4. A system in accordance with claim 3 wherein said left and right flanges extend in opposite directions from a common end of a central portion of said single bracket design.

5. A system in accordance with claim 3 wherein said left and right flanges extend in opposite directions from opposite ends of a central portion of said single bracket design.

6. A system in accordance with claim 1 wherein at least one of said supportive ribs is sufficiently flexible to accommodate a range of widths of a plurality of air conditioning air handler assemblies.

7. A system in accordance with claim 1 wherein said supportive ribs may be pivoted vertically with respect to said brackets to increase the size of said front opening as may be desired.

8. A system in accordance with claim 1 wherein at least one of said upper and lower supportive ribs includes a telescoping transverse rod.

* * * * *